US005425231A

United States Patent [19]

Burton

[11] Patent Number: 5,425,231

[45] Date of Patent: Jun. 20, 1995

[54] GAS FED PULSED ELECTRIC THRUSTER

[76] Inventor: Rodney L. Burton, 145 Oak Tree Rd., Seymour, Ill. 61875

[21] Appl. No.: 288,803

[22] Filed: Aug. 12, 1994

Related U.S. Application Data

[63] Continuation of Ser. No. 87,993, Jul. 2, 1993, abandoned.

[51] Int. Cl.[6] ..... B63H 11/00

[52] U.S. Cl. ..... 60/203.1

[58] Field of Search ..... 60/202, 203.1, 204; 313/359

[56] References Cited

U.S. PATENT DOCUMENTS

| | | | |
|---|---|---|---|
| 3,221,212 | 11/1965 | Gorowitz et al. | 60/202 |
| 3,239,130 | 3/1966 | Naundorf, Jr. | 60/202 |
| 3,321,919 | 5/1967 | Marolda | 60/203.1 |
| 3,425,223 | 2/1969 | Browning | 60/203.1 |
| 3,447,322 | 6/1969 | Mastrup | 60/203.1 |
| 3,575,003 | 4/1971 | LaRocca | 60/203.1 |
| 4,821,508 | 4/1989 | Burton et al. | 60/203.1 |
| 4,821,509 | 4/1989 | Burton et al. | 60/203.1 |

FOREIGN PATENT DOCUMENTS

| | | | |
|---|---|---|---|
| 1368255 | 6/1964 | France | 60/203.1 |
| 1598903 | 8/1970 | France | 60/203.1 |
| 00110781 | 7/1982 | Japan | 60/203.1 |
| 0090779 | 5/1984 | Japan | 60/203.1 |
| 0099073 | 6/1984 | Japan | 60/203.1 |
| 0067789 | 4/1985 | Japan | 60/203.1 |
| 1185360 | 3/1970 | United Kingdom | 60/203.1 |

OTHER PUBLICATIONS

"Electrothermal Hydrazine Thruster Development", Charles Murch, AIAA Paper No. 72-451, Apr. 1972.

*Primary Examiner*—Richard A. Bertsch
*Assistant Examiner*—Howard R. Richman
*Attorney, Agent, or Firm*—Roger M. Fitz-Gerald

[57] ABSTRACT

The present invention relates to a thruster for propelling a mass using a propellant gas which is repetitively converted to a pressurized plasma by pulses of electrical energy.

8 Claims, 2 Drawing Sheets

1/2

1/2

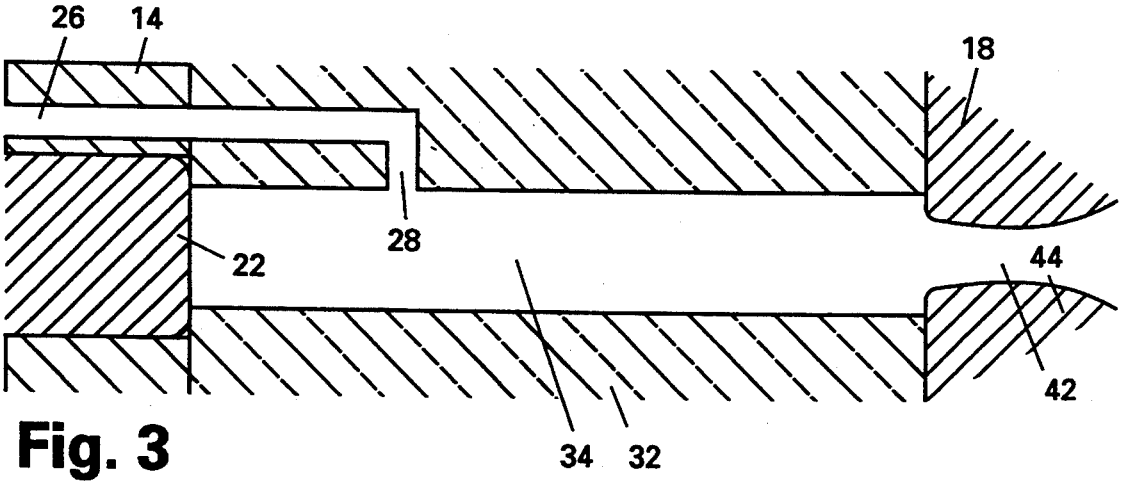
Fig. 3
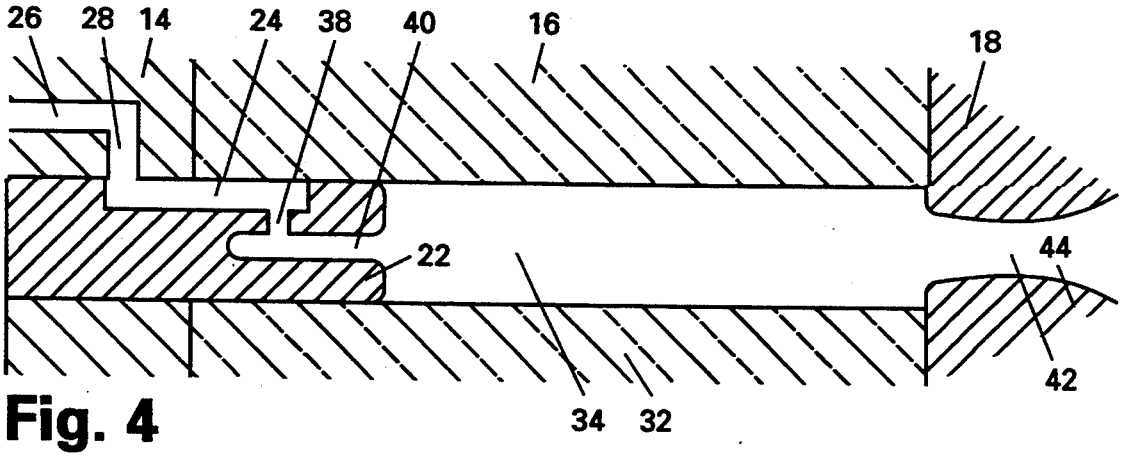
Fig. 4
Fig. 5
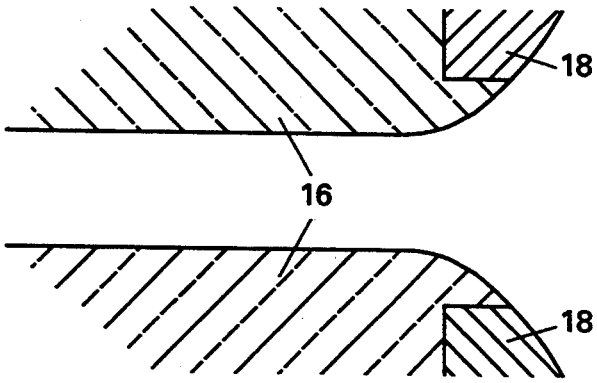

GAS FED PULSED ELECTRIC THRUSTER

This application is a continuation of application Ser. No. 08/087,993 filed Jul. 2, 1993, now abandoned.

SUMMARY OF THE INVENTION

The present invention relates to a thruster for propelling a mass using a propellant gas which is repetitively converted to a pressurized plasma by pulses of electrical energy.

BACKGROUND OF THE INVENTION

Applicant is a co-inventor under U.S. Pat. No. 4,821,509 issued on Apr. 18, 1989, for "Pulsed Electrothermal Thruster". This application relates to significant improvements in the apparatus and methods disclosed in the cited patent, which is the closest prior art known to applicant.

U.S. Pat. No. 4,821,509 includes a section entitled "Background Art" which discusses several prior patents and applications, may be of some interest to a worker in this field, and is incorporated herein by reference.

In summary, the prior patents and applications discussed in U.S. Pat. No. 4,821,509 all relate to the use of directed plasmas to accelerate or propel masses attached to the thruster which creates the plasma, or projectiles not attached to the thruster.

In all of those references, and in U.S. Pat. No. 4,821,509, plasmas are produced in elongated tubes and are discharged from one end of the tube to provide propelling force on either a separate projectile or the thruster tube which is attached to the mass. The plasmas in these devices are produced by ablation of the walls of the tube or from liquid or semiliquid fuels by electrical discharges within the tube.

The references and U.S. Pat. No. 4,821,509 are useful for certain purposes. However there are continuing needs for higher efficiency thrusters and also for low power thrusters for station keeping and maneuvering of small satellites with limited electrical power resources. The present invention provides improved solutions to these needs.

DESCRIPTION OF THE DRAWINGS

FIG. 3 is a detailed cross sectional view of a portion of another embodiment of the thruster according to the invention.

FIG. 4 is a detailed cross sectional view of a portion of still another embodiment of the thruster according to the invention.

FIG. 5 is a detailed cross sectional view of a portion of yet another embodiment of the thruster according to the invention.

DETAILED DESCRIPTION

Generally the present invention provides a new and improved electric thruster which operates with a gaseous propellant. Power is supplied to the propellant in a chamber by rapid electrical pulses which repetitively convert the propellant to a pressurized plasma. The plasma exits the chamber at high velocity which exerts propulsive force on the thruster, thus propelling it and any mass attached to it in the opposite direction of the exiting plasma or causing the propulsion of a projectile located beyond the exit opening in the path of the exiting plasma.

Figure 1:
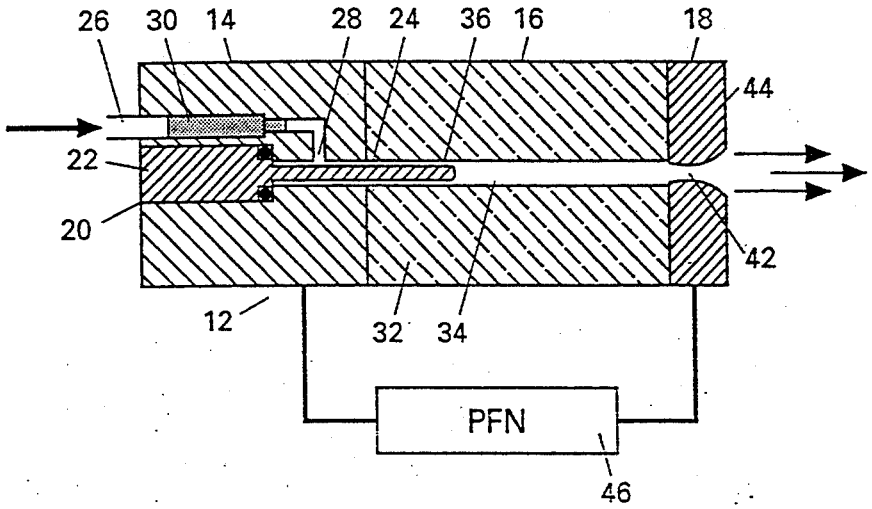
FIG. 1 is a longitudinal cross section, partially schematic, of a gaseous fueled thruster in accordance with the invention.

As shown in FIG. 1, one embodiment of the thruster includes a casing 12 which may be attached to a mass to be accelerated (not shown) or which may be adapted and located so as to propel a separate projectile (also not shown). The casing 12 includes a supply section 14, a discharge section 16 and an exit section 18. The casing is securely mounted on the mass to be accelerated or on a foundation when a separate projectile is to be accelerated, by means which are within the ordinary skill in the art.

As illustrated, the supply section 14 comprises a cylinder with a central longitudinally extending opening 20 accommodating a longitudinally extending cathode 22. The cathode 22 extends into the discharge section 16. The cathode is formed of a suitable conductive material such as tungsten. The cathode 22 has a smaller diameter in a portion adjacent the discharge section 16 thus providing an annular space or passageway 24 in the opening 20.

Also mounted within the supply section 14 is a conduit 26 which, as shown, extends longitudinally and is radially offset from the opening 20 into which is introduced gaseous propellant such as hydrogen, helium, hydrazine or ammonia or a mixture of two or more of the same, which is at high pressure in order to provide a steady flow of propellant. At present the preferred propellant appears to be hydrazine. The conduit 26 communicates with the annular passageway 24 through a radially extending conduit 28. Thus gaseous propellant flows from a high pressure reservoir (not shown) through conduits 26 and 28 into annular passageway 24. The rate of propellant flow is passively regulated by a calibrated orifice 30 with a known fluid resistance to provide a steady gas flow. One such device is manufactured by The Lee Company, Westbrook, Conn. under the name "Lee Visco Jet". Pulsed delivery of gas would be possible with other devices such as a fast acting valve.

The discharge section 16 comprises a cylinder 32 formed of a strong electrically insulating material such as boron nitride. Centrally within the discharge section is provided a capillary tube 34 which extends longitudinally within the discharge section. As illustrated in FIG. 1 the capillary tube 34 communicates with tube 36 which is a longitudinal extension of opening 20 in the supply section 14. Cathode 22 extends from the supply section 14 so that annular passageway 24 also extends into the discharge section 16. Typically the capillary tube will have a ratio of length to diameter of between 2 to 1 and 10 to 1.

Figure 2:
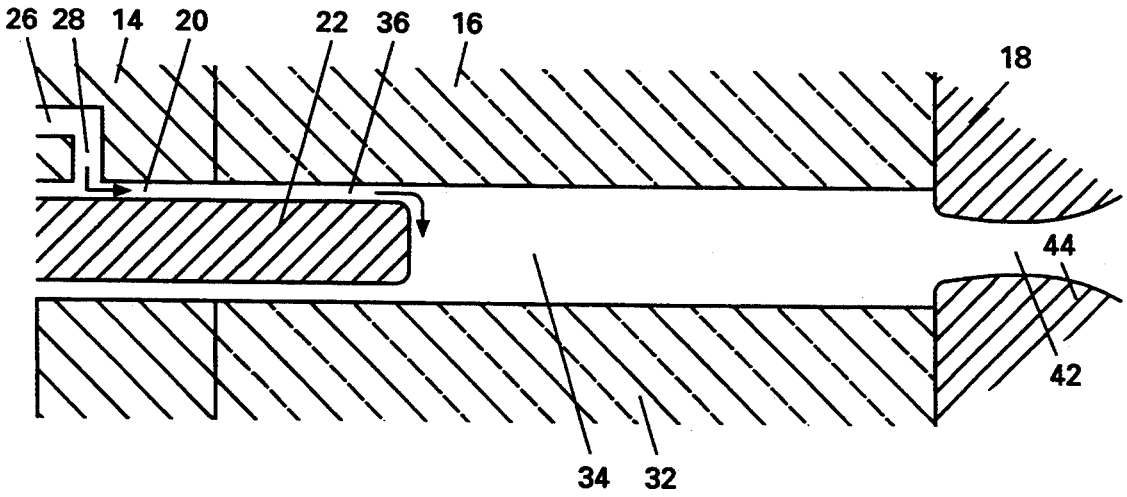
FIG. 2 is a detailed cross sectional view of a portion of the thruster shown in FIG. 1.

FIG. 2 is an enlarged view of the interface between supply section 14 and discharge section 16 showing by arrows how propellant gas enters capillary tube 34 by flowing through annular passageway 24 and around the end of cathode 22.

Other geometrical relationships of these parts may also be used and are shown in FIGS. 3 and 4.

FIG. 3 shows what, at present, is believed to be the preferred embodiment. There cathode 22 abuts and seals one end of capillary tube 34. Conduit 26 extends into discharge section 16. Radial conduit 28 is located within discharge section 16 communicating directly with capillary tube 34.

In FIG. 4 the end of cathode 22 is annular. A radial port 38 is provided between annular passageway 24 and central opening 40 in cathode 22. Thus propellant gas enters the capillary tube in a space directly surrounded by the end of cathode 22.

In each of these variations of the invention, discharge section 16 is adjacent to exit section 18. As shown in FIGS. 1-4, exit section is formed with a constricted throat 42 and a flared nozzle 44. The nozzle is conductive and constitutes an anode relative to cathode 22. Of course the electrical connections could be interchanged so that the nozzle functions as the cathode. In one embodiment the anode is tungsten. Pulsed electric currents of duration less than one microsecond to several microseconds between cathode 22 and nozzle anode 44 are supplied by pulse forming network 46. The design of such networks is conventional.

In operation, gaseous propellant flows into capillary tube 34 which constitutes a discharge chamber. Pulse forming network 46 supplies pulses of electric current between cathode 22 and anode 44. Using gaseous helium as a propellant, electric power has been supplied from 100 to 1,500 watts average power at about 1,000 peak amps and pulse rates typically between 300 and 6,000 pulses per second to convert the gas to a plasma. The pulse rate is desirably sufficiently rapid to minimize escape through the nozzle of unheated propellant between pulses. However, depending upon the desired application, average power could range from 50 watts to about 5 million watts.

The plasma produced by the discharge produces excess heat in the surrounding cylindrical layer which may be removed by coolant circulating around the casing 16, or by radiation from the outer surfaces of casing 16 and exit section 18. In one embodiment the capillary tube is 12.5 mm in length and 2.5 mm in diameter. Clearance between the cathode and the capillary wall is only 0.04 mm or less, which because of the small size relative to the tube minimizes propellant backflow. During the pulse, peak power has ranged between 50 and 250 kw, generating chamber pressures of 1 to 40 atmospheres. With these high pressures ionization in the capillary tube and frozen flow losses in the nozzle are reduced. The plasma exiting the nozzle either propels a mass attached to the thruster or impacts and propels a projectile located downstream.

The thruster as described offers several advantages over the prior art. Steady state electric thrusters are unreliable and unstable at lower power levels. Pulsed thrusters using ablation of solid walls or liquid propellants present difficulties in feeding the propellant into the discharge section. Gaseous propellants are more compatible with existing spacecraft propellant handling systems than liquid or ablated propellants. There is no danger of a gaseous propellant freezing within the system. Pulsed systems, as compared to steady state systems are more easily controlled as to output power by varying the supply current, the propellant mass flow rate or, in design, the geometry of the capillary tube and nozzle.

Another embodiment of the invention is shown in FIG. 5. In this variation the nozzle throat is eliminated by making the open nozzle anode 44 larger in diameter than the cathode 22. In operation, the pulse amplitude is increased from about 1,000 amps to between 10,000 and 25,000 peak amps and the frequency of pulses is increased to 10,000 to 20,000 pulses per second by suitable conventional modification of the pulse forming network. In this embodiment the gas is primarily accelerated by electromagnetic forces caused by the high current and the azimuthal magnetic field produced by that current.

Various changes and modifications could be made in the above described invention without departing from the scope of the claims.

I claim:

1. A thruster for propelling a mass comprising:

a. a gas supply means for supplying a propellant gas, b. an elongated capillary passage for receiving the propellant gas, said passage including at least one entry opening adjacent one end thereof for entry of the propellant gas and at least one exit opening adjacent the end of said passage opposite said entry opening, c. means for applying a series of electrical pulses at a rate of between 300 and 6,000 pulses per second to the propellant gas in said passage to produce electrical discharges in said passage comprising power supply means, pulse forming means operatively connected to said power supply means, electrodes comprising an anode adjacent one end of said passage and a cathode adjacent the other end of said passage, said anode and said cathode being operatively connected to said pulse forming means so as to provide said series of electrical pulses to the propellant gas between said anode and said cathode and convert the propellant gas to a series of pulses of high pressure plasma which flow through said exit opening and propel said mass, d. a constricted throat adjacent said exit opening of said passage which is smaller than said exit opening to prevent un-ionized propellant gas between said pulses of said high pressure plasma from exiting said passage, and e. a nozzle adjacent said throat which is flared outwardly from said throat.

2. A thruster according to claim 1 wherein said means for applying a series of electrical pulses applies pulses at substantially 1,000 peak amps.

3. A thruster according to claim 1 wherein said gas supply means supplies the propellant gas continuously to said passage.

4. A thruster according to claim 1 wherein said passage has a ratio of length to diameter of between 2 to 1 and 10 to 1.

5. A thruster for propelling a mass comprising:

a. a gas supply means for supplying a propellant gas, b. an elongated capillary passage for receiving the propellant gas, said passage including at least one entry opening adjacent one end thereof for entry of the propellant gas and at least one exit opening adjacent the end of said passage opposite said entry opening, c. means for applying a series of electrical pulses at a rate of between 10,000 and 20,000 pulses per second to the propellant gas in said passage to produce electrical discharges in said passage comprising power supply means, pulse forming means operatively connected to said power supply means, electrodes comprising an anode adjacent one end of said passage and a cathode adjacent the other end of said passage, said anode and said cathode being operatively connected to said pulse forming means so as to provide said series of electrical pulses to the propellant gas between said anode and said cathode and convert the propellant gas to a series of pulses of high pressure plasma which flow through said exit opening and propel said mass, d. a constricted throat adjacent said exit opening of said passage which is no larger than said exit opening to prevent un-ionized propellant gas between said pulses of said high pressure plasma from exiting said passage, and e. a nozzle adjacent said throat which is flared outwardly from said throat.

6. A thruster according to claim 5 wherein said means for applying a series of electrical pulses applies pulses at between 10,000 and 25,000 peak amps.

7. A thruster according to claim 6 wherein said gas supply means supplies the propellant gas continuously to said passage.

8. A thruster according to claim 6 wherein said passage has a ratio of length to diameter of between 2 to 1 and 10 to 1.

* * * * *